US007777705B2

(12) United States Patent
Wei et al.

(10) Patent No.: US 7,777,705 B2
(45) Date of Patent: Aug. 17, 2010

(54) ORGANIC LIGHT EMITTING DIODE DRIVING DEVICE

(75) Inventors: Hsiang-Yun Wei, Taipei (TW); Chun-Yuan Hsu, Taipei County (TW); Che-Cheng Kuo, Taoyuan County (TW); Chun-Yao Huang, Hsinchu (TW); Jan-Ruei Lin, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 609 days.

(21) Appl. No.: 11/754,309

(22) Filed: May 27, 2007

(65) Prior Publication Data

US 2008/0106504 A1 May 8, 2008

(30) Foreign Application Priority Data

Nov. 2, 2006 (TW) ..... 95140536 A

(51) Int. Cl.
*G09G 3/32* (2006.01)

(52) U.S. Cl. ..... 345/82; 345/76; 345/91; 313/500; 315/169.3

(58) Field of Classification Search ..... 345/76, 345/55, 82, 84, 90–93, 204; 257/40, 59, 257/72, 290, 291, 642; 438/99; 340/815.45; 313/500, 504, 506; 315/169.3
See application file for complete search history.

(56) References Cited

U.S. PATENT DOCUMENTS 7,327,357 B2 * 2/2008 Jeong ..... 345/204
7,508,361 B2 * 3/2009 Uchino et al. ..... 345/76
7,573,441 B2 * 8/2009 Kwon ..... 345/76
2005/0052366 A1 3/2005 Kim
2005/0206593 A1 9/2005 Kwon

FOREIGN PATENT DOCUMENTS

| | | |
|---|---|---|
| CN | 1510652 | 7/2004 |
| CN | 1516090 | 7/2004 |
| CN | 1534568 | 10/2004 |
| CN | 1804977 | 7/2006 |

OTHER PUBLICATIONS

Article titled "A New Voltage-Modulated AMOLED Pixel Design Compensating for Threshold Voltage Variation in Poly-Si TFTs" authored by Jung et al., IEEE Electron Device Letters, vol. 25, No. 10, Oct. 2004 (pp. 690-692).
"Office Action of Taiwan Counterpart Application", issued on Apr. 21, 2010, p1-p6.

* cited by examiner

*Primary Examiner*—Abbas I Abdulselam
(74) *Attorney, Agent, or Firm*—Jianq Chyun IP Office

(57) ABSTRACT

The present invention discloses an OLED driving device, including a first switch transistor, a first transistor, a second switch transistor, a storage capacitor and a second transistor. The first switch transistor is used to receive a data signal, and output the data signal by the control of a first scan signal. The first transistor is used to compensate the effect of the threshold voltage of the second transistor. The second switch transistor is used to receive a voltage signal, and output the voltage signal by the control of a second scan signal. The storage capacitor is used to store a data voltage. The second transistor is electrically connected to the second switch transistor through the storage capacitor. The present invention can efficiently release the charges from the storage capacitor, enhance display effect, and change the input voltage level for adapting different operating voltages of integrate circuits.

7 Claims, 5 Drawing Sheets

ORGANIC LIGHT EMITTING DIODE DRIVING DEVICE

CROSS-REFERENCE TO RELATED APPLICATION

This application claims the priority benefit of Taiwan application serial no. 95140536, filed Nov. 2, 2006. All disclosure of the Taiwan application is incorporated herein by reference.

BACKGROUND OF THE INVENTION

1. Field of Invention

The present invention relates to a driving device. More particularly, the present invention relates to an organic light emitting diode (OLED) driving device.

2. Description of Related Art

FIG. 1 shows a circuit diagram of a conventional OLED driving device. The OLED driving device in FIG. 1 comprises P-type metal oxide semiconductor (MOS) transistors 101~106 for driving an OLED 107. A control end of the transistor 101 receives a first select signal S1, and controls the input of a data signal Vdata. The data signal Vdata is input into the storage capacitor 104 via the transistor 102, and the voltage on the storage capacitor 104 controls the gate of the transistor 105. Thus, an output end of the transistor 105 generates a current corresponding to the voltage. The gate of the transistor 106 is controlled by a second select signal S2. The current generated by the transistor 105 passes through the transistor 106 and drives the OLED 107 to emit light, and the charges of the storage capacitor 104 are released via the transistor 103.

FIG. 2 shows a voltage-to-time waveform chart of the data signal Vdata, the first select signal S1 and the second select signal S2. During the time period T11~T12, the first select signal S1 is at a low level, and this is the reset period of the storage capacitor 104. During the time period T12~T14, the data voltage Vdata is at a high level, and it is the data storing period of the storage capacitor 104. During the time period T13~T14, the second select signal S2 is at a low level, and it is the light-emitting period. At this time period, the OLED 107 emits light due to the current generated by the transistor 105.

The conventional circuit design is using the transistor 102 to compensate the effect of the threshold voltage of the transistor 105. The threshold voltages of the transistor 102 and the transistor 105 are respectively $V_{th\text{-}102}$ and $V_{th\text{-}105}$, the current flowing through the transistor 105 is I, and k is a proportional constant. Thus, the following relation can be obtained:

$$I=(k/2)*(V\text{data}-|V_{th\text{-}102}|-VDD+|V_{th\text{-}105}|)^2$$

Under ideal conditions, the threshold voltage $V_{th\text{-}102}$ of the transistor 102 is identical to the threshold voltage $V_{th\text{-}105}$ of the transistor 105, and thus the following relation can be obtained:

$$I=(k/2)*(V\text{data}-VDD)^2$$

It may be known from this relation that, the current I is not affected by the threshold voltages. However, the disadvantage of the conventional circuit is the mechanism of using the data signal Vdata to discharge the storage capacitor 104. If the voltage at the node n1 is close to that of the data signal Vdata, charges of the storage capacitor 104 cannot be completely released. Moreover, the charging mechanism cannot be adapted for integrated circuits with operating voltages of different specifications.

SUMMARY OF THE INVENTION

The object of the present invention is to provide an OLED driving device, which can improve the display quality of an OLED, effectively release charges of the storage capacitor, change the level of the input voltage to match integrated circuits with operating voltages of different specifications, and can be fabricated by low temperature poly silicon process or amorphous silicon process.

The present invention provides an OLED driving device, comprising a first switch, a first transistor, a second switch, a capacitor and a second transistor. One end of the first switch is used to receive a data signal, and output the data signal to a first end of the first transistor via the control of a first scan signal. A control end of the first transistor is electrically connected to a second end of itself, thus the first transistor is equivalent to a virtual diode structure for compensating a threshold voltage of the second transistor. The second switch is used to receive a voltage signal and output the voltage signal via the control of a second scan signal. One end of the capacitor is electrically connected to the second switch and the other end of the capacitor is connected to the second end of the first transistor, for storing the data voltage. A control end of the second transistor is electrically connected to the second end of the first transistor and the other end of the capacitor, for generating a driving current input to a third switch. The third switch is used to prevent the OLED from improperly emitting light. The third switch outputs the driving current via the control of the second scan signal.

According to the OLED driving device described by preferred embodiments of the present invention, the above-mentioned third switch is electrically connected to one end of the OLED, and the other end of the OLED is electrically connected to a second reference voltage. The first switch, the second switch and the third switch are respectively the third transistor, the fourth transistor and the fifth transistor. The OLED driving device can be fabricated by low temperature poly silicon process or amorphous silicon process.

By adopting the second switch to introduce the voltage signal into the capacitor, the present invention can effectively release charges of the storage capacitor, improve the display quality of the OLED, and change the level of the input voltage to match integrated circuits with operating voltages of different specifications. The circuit design of the present invention is suitable for low temperature poly silicon process or amorphous silicon process.

In order to the make aforementioned and other objects, features and advantages of the present invention more comprehensible, preferred embodiments accompanied with figures are described in detail below.

DESCRIPTION OF EMBODIMENTS

Figure 1:
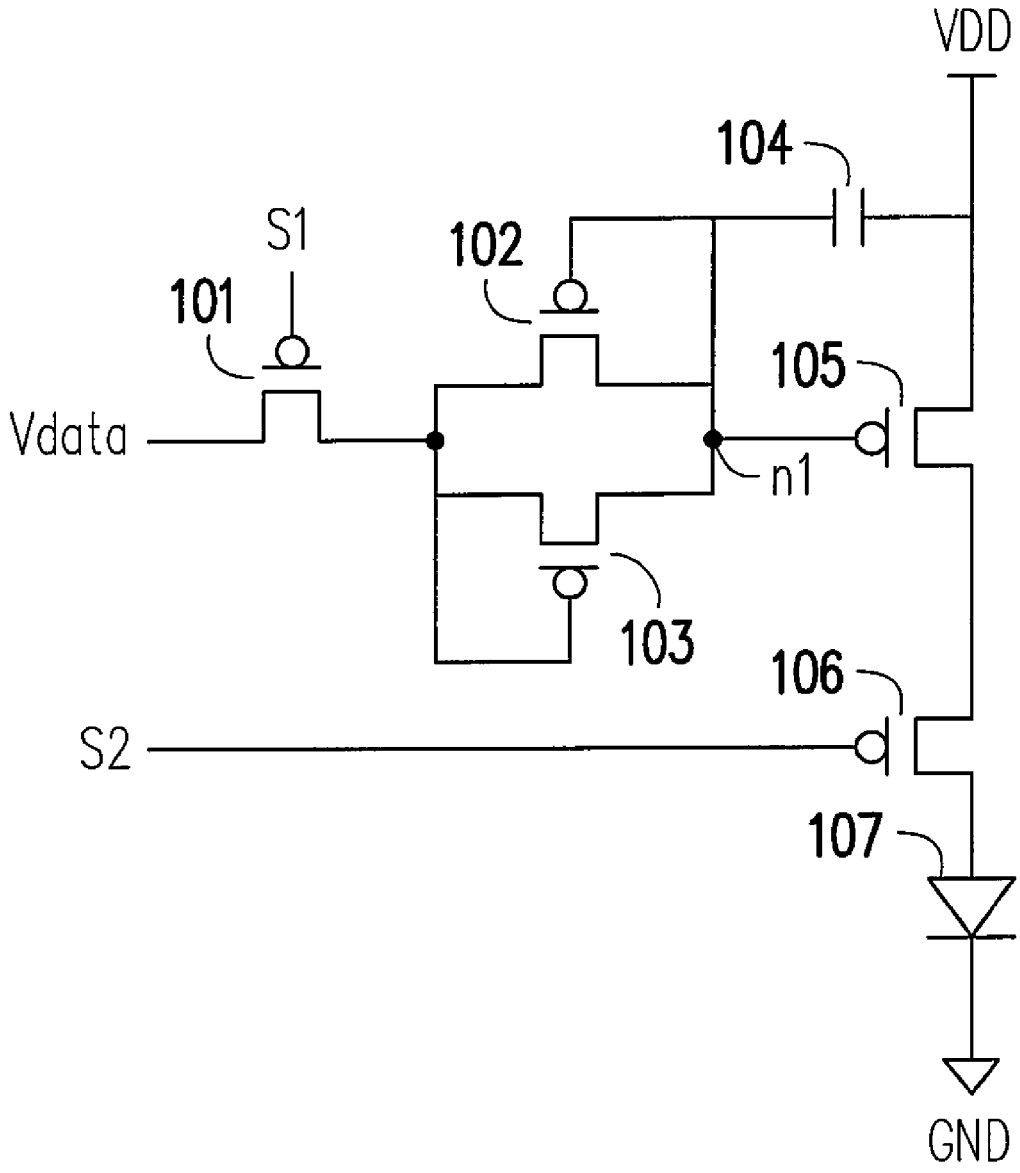
FIG. 1 (PRIOR ART)
FIG. 1 shows a circuit diagram of a conventional OLED driving device.
Figure 2:
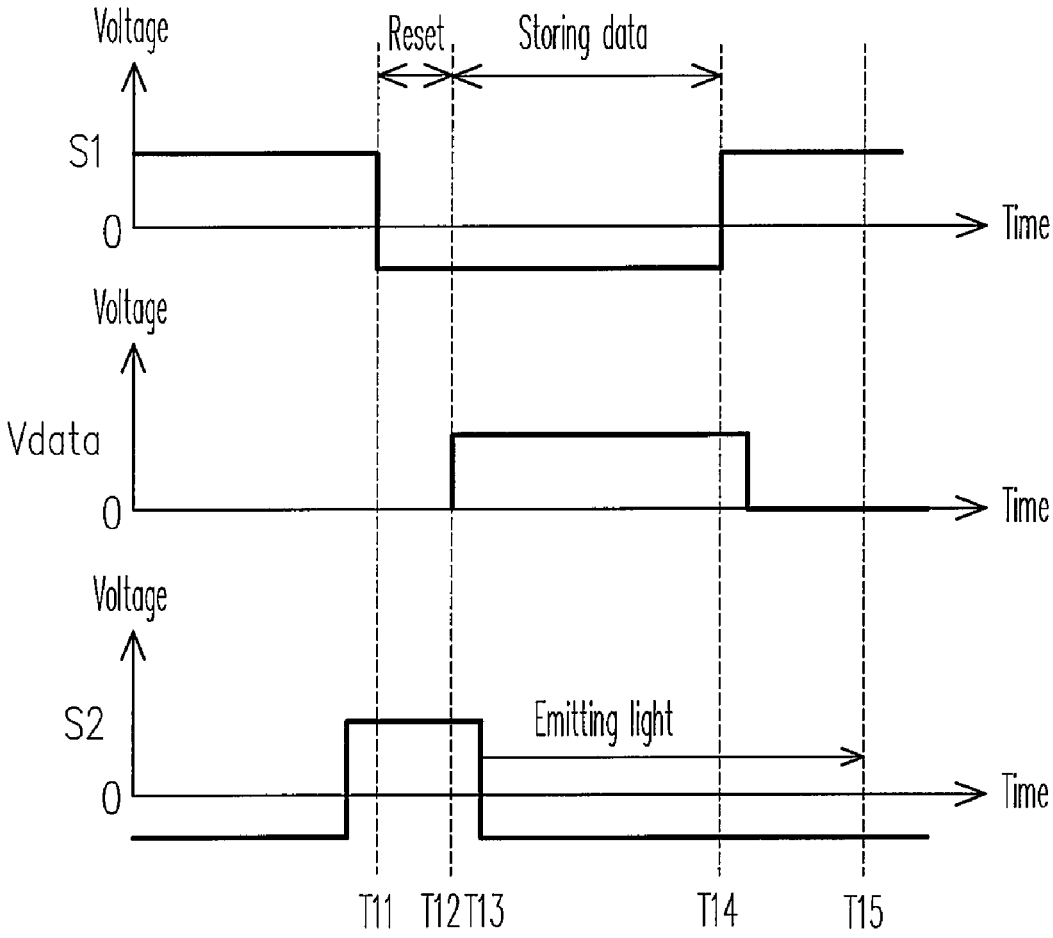
FIG. 2 (PRIOR ART)
FIG. 2 shows a voltage-to-time waveform chart of the data signal Vdata, the first select signal S1 and the second select signal S2.
Figure 3:
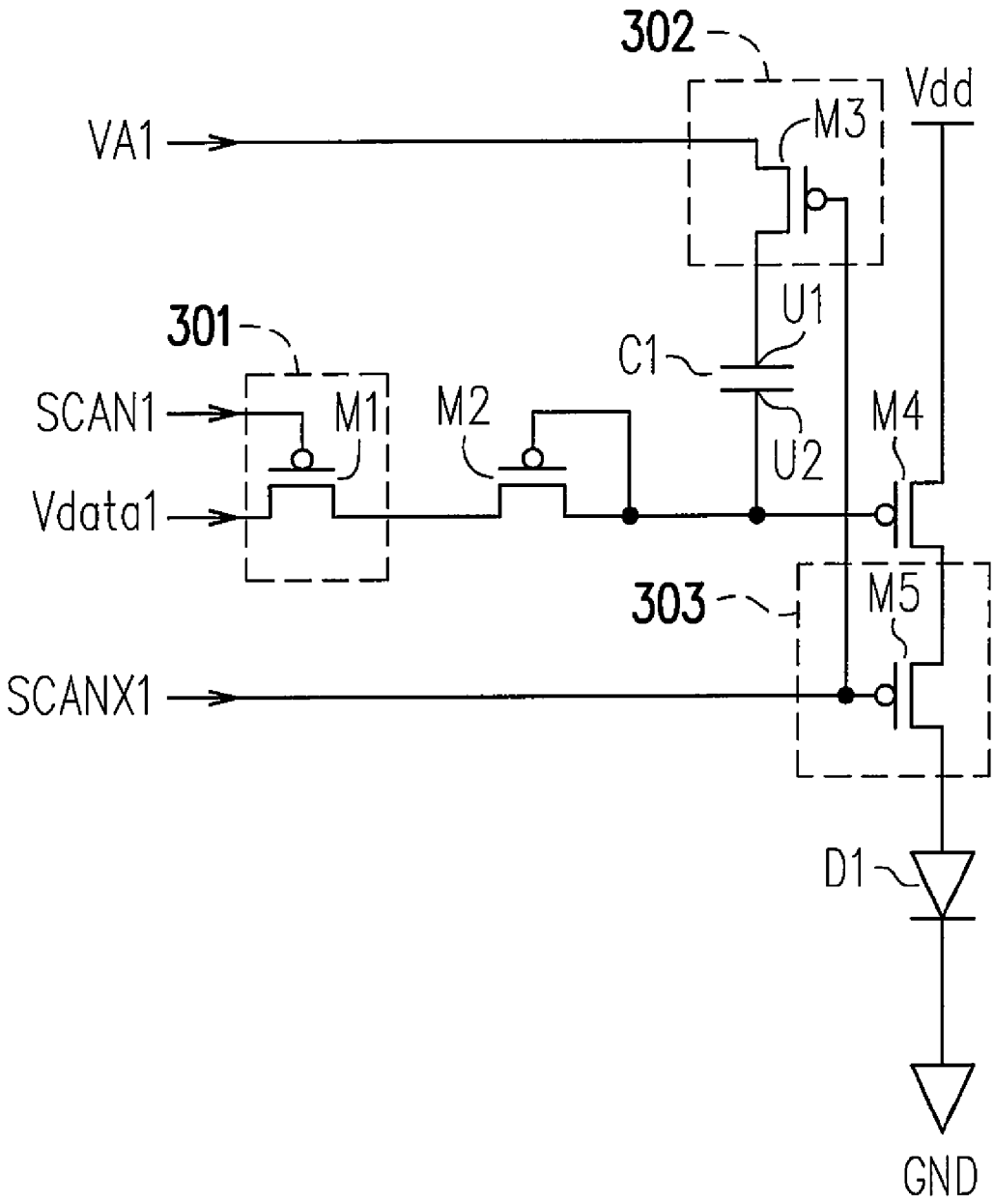
FIG. 3 shows a circuit diagram of an OLED driving device according to an embodiment of the present invention.

FIG. 3 shows a circuit diagram of an OLED driving device according to an embodiment of the present invention. The OLED driving device in FIG. 3 comprises a first switch transistor 301, a second switch transistor 302, a third switch transistor 303, P-type MOS first transistor M2 and P-type MOS second transistor M4, a storage capacitor C1 and an OLED D1. A data signal Vdata1 is input to the first switch transistor 301, which can be implemented by the P-type MOS third transistor M1. The third transistor M1 receives a data signal Vdata with a first end, and receives a first scan signal SCAN with a control end, so as to control the outputting the data signal Vdata. The first transistor M2 is electrically connected to the other end of the third transistor M1 to receive the data signal Vdata. The control end of the first transistor M2 is electrically connected to a second end of itself to form a virtual diode structure, so as to compensate the threshold voltage of the second transistor M4. The second transistor M4 is used to output a driving current.

The storage capacitor C1 is used to store the data voltage. An end U1 of the storage capacitor C1 is electrically connected to the second switch transistor 302, and an end U2 of the storage capacitor C1 is electrically connected to the first transistor M2. An end of the second switch transistor 302 is used to receive a voltage signal VA1. The second switch transistor 302 receives a second scan signal SCANX1 and outputs the voltage signal VA1 to the storage capacitor C1 under the control of the second scan signal SCANX1. The second switch transistor 302 may be implemented by the P-type MOS fourth transistor M3. This embodiment employs the voltage signal VA1 to effectively release charges of the storage capacitor C1. Due to variable factors of manufacturing process, temperature, etc., the changing of the threshold voltage influences the driving current output by the second transistor M4. The circuit design of this embodiment improves the circuit stability by compensating the influence of the threshold voltage. The control end of the second transistor M4 receives the data voltage of the storage capacitor C1 to output a driving current. An end of the second transistor M4 is electrically connected to the first reference voltage Vdd, and the other end is electrically connected to the third switch transistor 303. The third switch transistor 303 is electrically connected to the OLED D1. A second scan signal SCANX1 is used to control the third switch transistor 303 to determine whether the driving current of the second transistor M4 is input to the positive end of the OLED D1, and the negative end of the OLED D1 is electrically connected to the second reference voltage GND, which is a ground voltage. The ON/OFF operations of the third switch transistor 303 are used to prevent the OLED D1 from emitting light improperly. The third switch transistor 303 may be implemented by the P-type MOS fifth transistor M5.

Figure 4:
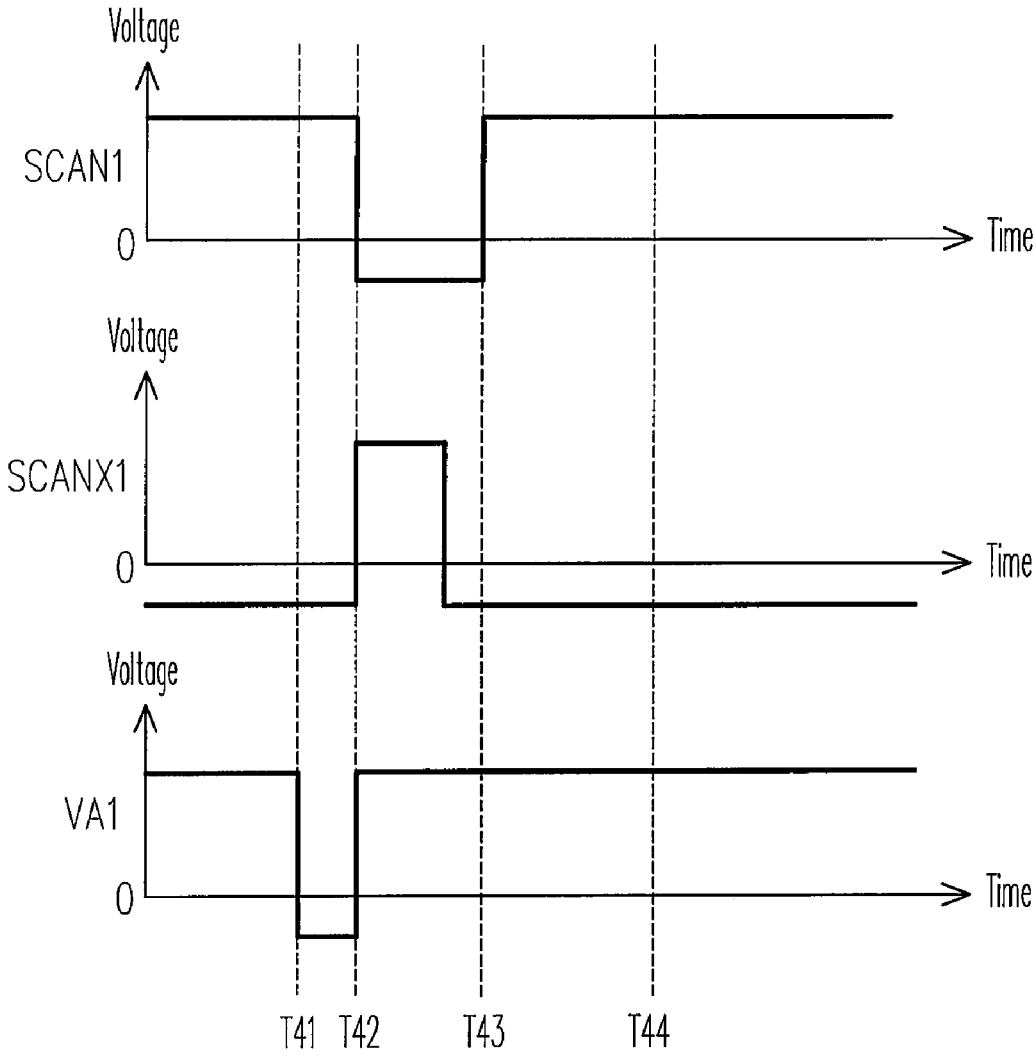
FIG. 4 shows a voltage-to-time waveform chart of the voltage signal VA1, the first scan signal SCAN1 and the second scan signal SCANX1.

FIG. 4 shows a waveform chart of the voltage signal VA1, the first scan signal SCAN1 and the second scan signal SCANX1 against time. The time period T41~T42 is a reset period for the storage capacitor C1. The second scan signal SCANX1 is at the low voltage level. The fourth transistor M3 is turned on, and the end U1 of storage capacitor C1 is pulled to the low voltage level. The voltage of the end U2 of the storage capacitor C1 is lowered by the voltage difference from the high voltage level to the low voltage level of VA1. The voltage of the end U2 of the storage capacitor C1 is lowered, so as to correctly write correct data value of the data signal Vdata in the next timing without affecting the accuracy of data value due to the charges originally in the storage capacitor C1.

The time period T42~T43 is a writing period for the data voltage. During this period, the first scan signal SCAN1 is at the low voltage level. The third transistor M1 is turned on. The second scan signal SCANX1 is at the high voltage level. The fourth transistor M3 and the fifth transistor M5 are turned off, whose main purpose is writing the voltage of the data signal Vdata into the storage capacitor C1. The control end of the first transistor M2 is electrically connected to the output end of itself so that M2 is equivalent to a diode, and thus, the voltage at the end U2 of the storage capacitor C1 is (Vdata−$V_{th\text{-}M2}$), where $V_{th\text{-}M2}$ is the threshold voltage of the first transistor M2. The time period T43~T44 is the light-emitting period of the OLED. The second scan signal SCANX turns on the fourth transistor M3 and the fifth transistor M5. $V_{th\text{-}M5}$ is the threshold voltage of the fifth transistor M5, and Id is the driving current, with reference to the following relation:

$$Id=(k/2)*(V\text{data}1-|V_{th\text{-}M2}|-Vdd+|V_{th\text{-}M5}|)^2$$

The design principle of this embodiment is that, the threshold voltage $V_{th\text{-}M2}$ of the first transistor M2 is equal to the threshold voltage $V_{th\text{-}M4}$ of the second transistor M4, such that the following relation is obtained:

$$Id=(I/2)*(V\text{data}1-Vdd)^2$$

Thus, the luminosity of the OLED D1 is in direct proportion to Id, and is not related to the variance of the threshold voltage of the second transistor M4.

Figure 5:
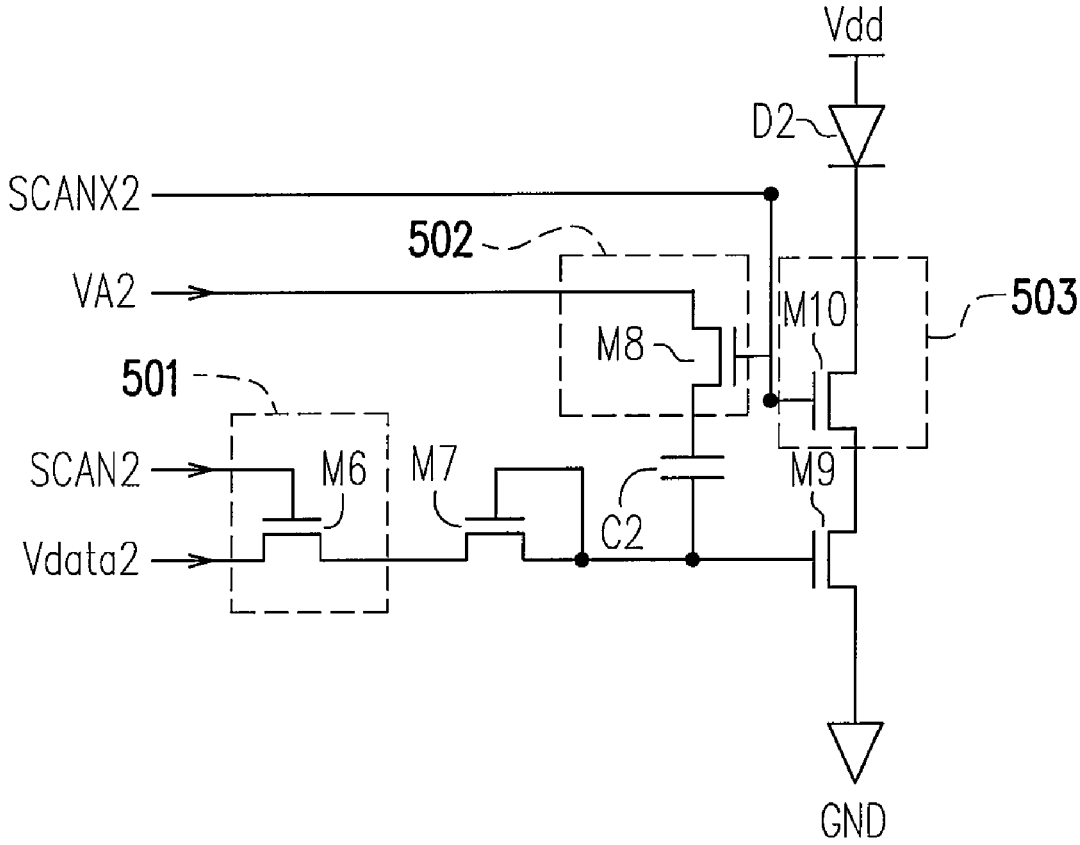
FIG. 5 shows a circuit diagram of an OLED driving device according to another embodiment of the present invention.

FIG. 5 shows a circuit diagram of an OLED driving device according to another embodiment of the present invention. Concerning that FIG. 3 uses an all P-type MOS transistor structure, the OLED driving device of this embodiment comprises the first switch transistor 501, the second switch transistor 502, the fourth switch transistor 503, N-type MOS first transistor M7, N-type MOS second transistor M9, a storage capacitor C2 and the OLED D2, so as to form an all N-type MOS transistor structure. The first switch transistor 501, the second switch transistor 502 and the fourth switch transistor 503 include the third transistor M6, the fourth transistor M8 and the sixth transistor M10, respectively. The ON/OFF operations of the first transistor M7 are determined by a first scan signal SCAN2. The second scan signal SCANX2 controls the sixth transistor M10, so as to prevent the driving current from flowing at the improper time and thereby resulting in an improper light-emitting of the OLED D2. The second transistor M9 is electrically connected to the reference voltage GND, which is a ground voltage. An end of the fourth switch transistor 503 is electrically connected to the second end of the second transistor M9. The fourth switch transistor 503 is controlled by the second scan signal SCANX2 and outputs the driving current generated by the fourth transistor M8 to the OLED D2. The other end of the fourth switch transistor 503 is electrically connected to the negative end of the OLED D2. The positive end of the OLED D2 is electrically connected to the third reference voltage VDD, which is a voltage source. The fourth transistor M8 introduces a voltage VA2 into the storage capacitor C2 under the control of the second scan signal SCANX2, for resetting the storage capacitor C2. The first scan signal SCAN2 and the second scan signal SCANX2 are inverted from the first scan signal SCAN1 and the second scan signal SCANX1 in the previous embodiment respectively.

In the OLED driving device of the above-mentioned embodiments, the transistors may be implemented by thin film transistors, which are suitable for the low temperature poly silicon process and the amorphous silicon process. The transistor of the above-mentioned OLED driving device may employ an all P-type MOS process or an all N-type MOS process. In addition, the device for generating the first scan signal, the second scan signal, and the voltage signal may employ an all P-type MOS process or an all N-type MOS process, together with the manufacturing process of the OLED, so as to save manufacturing costs, unify the process, improve yields and reduce variations.

In summary, the OLED driving device of the present invention adopts a mechanism of using the voltage signal to control the storage capacitor via the switch transistor, therefore the present invention can improve the display quality of the OLED, effectively release the charges of the storage capacitor, change the level of the input voltage to match integrated circuits with operating voltages of different specifications, and can be fabricated by low temperature poly silicon process or amorphous silicon process.

Though the present invention has been disclosed above by the preferred embodiments, it is not intended to limit the invention. Anybody skilled in the art can make some modifications and variations without departing from the spirit and scope of the invention. Therefore, the protecting range of the invention falls in the appended claims.

What is claimed is:

1. An organic light emitting diode (OLED) driving device, comprising:

a first switch, wherein a first end of the first switch is used to receive a data signal, and a control end of the first switch is used to receive a first scan signal;

a first transistor, wherein a first end of the first transistor is electrically directly connected to a second end of the first switch, and a control end of the first transistor is electrically directly connected to a second end of the first transistor;

a second switch, wherein a first end of the second switch is used to receive a voltage signal, and a control end of the second switch is used to receive a second scan signal;

a capacitor, wherein a first end of the capacitor is electrically directly connected to a second end of the second switch, and a second end of the capacitor is electrically directly connected to the second end of the first transistor;

a second transistor, wherein a control end of the second transistor is electrically directly connected to the second end of the first transistor and the second end of the capacitor, a first end of the second transistor is electrically directly connected to a first reference voltage, and a second end of the second transistor is used to generate a driving current so as to drive an OLED; and a third switch, wherein a first end of the third switch is electrically directly connected to the second end of the second transistor, a control end of the third switch is used to receive the second scan signal, and a second end of the third switch is electrically directly connected to a first end of the OLED, wherein a second end of the OLED is electrically directly connected to a second reference voltage.

2. The OLED driving device as claimed in claim 1, wherein the first reference voltage is a supply voltage, the second reference voltage is a ground voltage, the first end of the OLED is a positive end, and the second end of the OLED is a negative end.

3. The OLED driving device as claimed in claim 2, wherein the first switch, the second switch and the third switch are respectively a third transistor, a fourth transistor and a fifth transistor.

4. The OLED driving device as claimed in claim 3, wherein the first transistor, the second transistor, the third transistor, the fourth transistor and the fifth transistor are all P-type MOS transistors.

5. The OLED driving device as claimed in claim 1, wherein the first reference voltage is a ground voltage, the second reference voltage is a supply voltage, the first end of the OLED is a negative end, and the second end of the OLED is a positive end.

6. The OLED driving device as claimed in claim 5, wherein the first switch, the second switch and the third switch are respectively a third transistor, a fourth transistor and a fifth transistor.

7. The OLED driving device as claimed in claim 6, wherein the first transistor, the second transistor, the third transistor, the fourth transistor and the fifth transistor are all N-type MOS transistors.

* * * * *